United States Patent [19]

Endo et al.

[11] Patent Number: 5,044,239

[45] Date of Patent: Sep. 3, 1991

[54] PUNCH FOR PUNCH PRESS

[75] Inventors: Shigeru Endo, La Mirada; Yoshinori Kiuchi, Hacienda Heights, both of Calif.

[73] Assignee: Amada Engineering & Service Co., Inc., La Mirada, Calif.

[21] Appl. No.: 418,934

[22] Filed: Oct. 6, 1989

Related U.S. Application Data

[63] Continuation of Ser. No. 160,395, Feb. 25, 1988, abandoned.

[51] Int. Cl.[5] ..... B21D 28/36; B26F 1/04

[52] U.S. Cl. ..... 83/133; 83/140; 83/549; 83/552; 83/691

[58] Field of Search ..... 83/378, 383, 386, 549, 83/550, 552, 571, 588, 618, 620, 621, 691, 140, 124, 125, 133

[56] References Cited

U.S. PATENT DOCUMENTS

| | | | |
|---|---|---|---|
| 1,736,049 | 11/1929 | Nordendale | 83/622 |
| 3,527,309 | 9/1970 | Knehans | 83/588 |
| 3,902,389 | 9/1975 | Brown et al. | 83/588 X |
| 4,134,317 | 1/1979 | Goel et al. | 83/552 X |
| 4,250,785 | 2/1981 | Morishita et al. | 83/552 |
| 4,532,845 | 8/1985 | Jinnouchi | 83/552 |
| 4,546,683 | 10/1985 | Völkel et al. | 83/552 X |
| 4,569,267 | 2/1986 | Klingel | 83/552 |
| 4,623,089 | 11/1986 | Scott | 83/571 X |
| 4,738,173 | 4/1988 | Kiuchi | 83/620 X |

FOREIGN PATENT DOCUMENTS

| | | | |
|---|---|---|---|
| 1502721 | 1/1970 | Fed. Rep. of Germany | 83/549 |
| 2071554 | 9/1981 | United Kingdom | 83/552 |

*Primary Examiner*—Hien H. Phan
*Attorney, Agent, or Firm*—Wigman & Cohen

[57] ABSTRACT

A punch for a punch press includes a punch holder which is installed on a punch installing portion of the punch press and a plurality of punch bodies so supported on the punch holder as to be independently movable in the vertical direction. Shearing blade portions are formed on the lower ends of the respective punch bodies. The shearing blade portions have elongated configurations, each extending in a different direction in the horizontal plane.

8 Claims, 3 Drawing Sheets

PUNCH FOR PUNCH PRESS

This is a continuation of co-pending application Ser. No. 07/160,395 filed on Feb. 25, 1988, now abandoned.

BACKGROUND OF THE INVENTION

1. Field of the Invention

This invention relates to a punch for a punch press and more particularly to a punch which is mounted on a punch installing portion of a punch press and is useful, for example, in case of shearing and separating rectangular small products from a rectangular large sheet material.

2. Description of the Prior Art

In a punch press such as a turret punch press or the like, there is provided a positioning device which will move in X-axis and Y-axis directions to position a large rectangular sheet material against punching tools mounted on the punch press. That is to say, in a punch press, moving and positioning the sheet material against the punching tools by using positioning device, punching is performed on a desired location of a sheet material.

Meanwhile, in recent years, in order to produce a wide variety of products by small number for each variety, a manufacturing method is adopted in which various punchings are performed on a large sheet material in advance, and then thereafter the respective various products each having various punched holes, are sheared and separated from said sheet material.

The above-described manufacturing method is conventionally performed, for instance, in an arrangement in which a shearing machine having an L-shaped shearing blade is disposed adjacent to a punch press. And, in the arrangement, after the punching is performed on the sheet material at the turret punch press, the sheet material will be moved to a side of the shearing machine and holded by a positioning device of the shearing machine. Thereafter, process of positioning of the sheet material and those of shearing and separation of small products from the sheet material are automatically performed by the shearing machine.

In the prior art as described above, however, a transport device to transport the sheet material from the punch press to the shearing machine is required. Therefore the arrangement becomes complicated, and moreover, time is consumed to transport the sheet material, resulting in that work efficiency becomes low. Further, since the sheet material is holded by the positioning devices of shearing machine as well as that of the punch press, positioning error of the sheet material on the punch press and that of on the shearing machine is added up, resulting in that there occured a problem that processing accuracy will be lowered.

SUMMARY OF THE INVENTION

In view of the foregoing, it is therefore an object of the present invention to provide a punch which make it possible to efficiently and easily shear and separate small products from a large sheet material in a punch press.

The foregoing object are achieved in the present invention wherein there is provided a punch for a punch press comprising, a punch holder which is detachably installed on a punch installing portion of the punch press, a plurality of punch bodies supported on said punch holder so as to be freely movable in vertical direction, and shearing blade portions formed on the lower ends of the respective punch bodies, the shearing blade portions having elongated configurations each extending in different direction in horizontal plane.

In a punch press provided with the above-mentioned punch, a straight line slit with desired length and direction is formed in a sheet material when the sheet material is repeatedly punched by one of the punch bodies while moved in a lengthwise direction of the shearing blade portion of the punch body; and thereafter when the sheet material is repeatedly punched by the other punch body while moved in a lengthwise direction of the other shearing blade portion, another straight line slit crossing the above-mentioned slit is formed on the sheet material.

This will enable forming a L-shaped slit in the sheet material and enable shearing and separating small products from a sheet material.

That is to say, according to this invention, small products can be sheared and separated from a large sheet material by performing repeated punching operations with the use of shearing blade portions of the respective punch bodies supported on a single punch holder. Accordingly, with this invention, while shearing and separating the small products, the sheet material will be kept to be holded by the positioning device of the punch press, and moreover, the sheet material need only to be moved by a short distance from a position corresponding to one shearing blade portion to a position corresponding to the other shearing blade portion; therefore, the shearing and separation of small products from a large sheet material can be carried out accurately and efficiently.

These and other objects, features and advantages of the present invention will be more apparent from the following description of a preferred embodiment taken in conjunction with the accompanying drawings.

DETAILED DESCRIPTION OF THE PREFERRED EMBODIMENT

Figure 1:
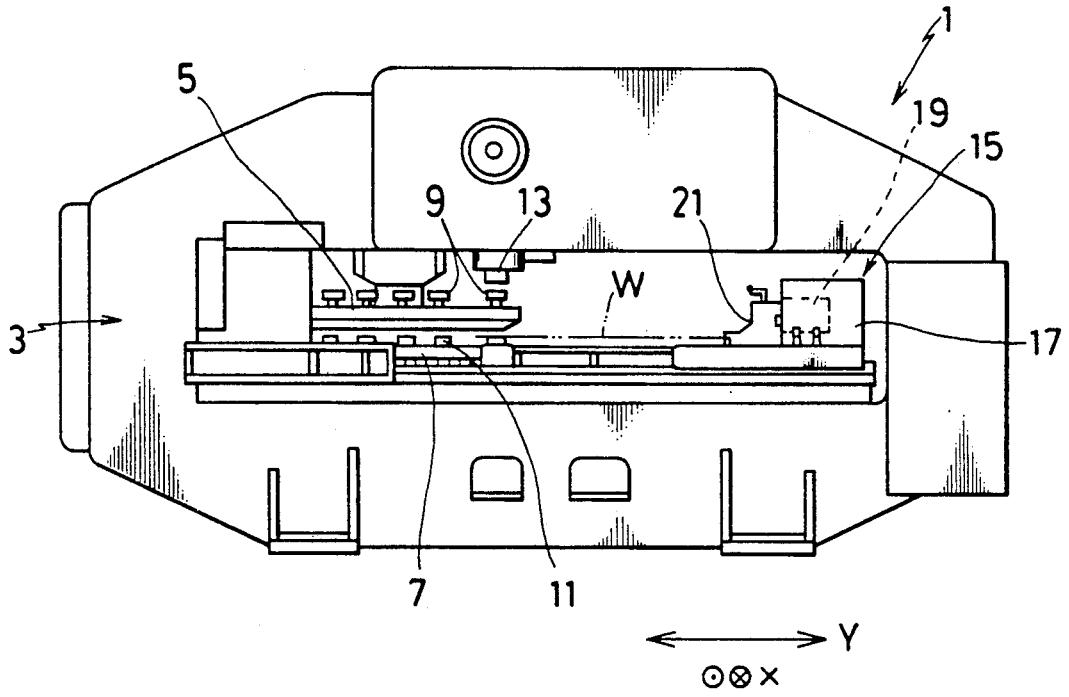
FIG. 1 is a front view of a turret punch press provided with an embodiment of the present invention.

Referring to FIG. 1, a turret punch press 1 is shown as an example of a punch press having punches according to the present invention. The kind of the turret punch press is well known. However, in order to facilitate the understanding of the manner in which a punch of the present invention is applied, a brief description will be made on its overall construction.

The turret punch press 1 has a frame 3. On the frame 3, upper turret 5 and lower turret 7 are rotatably supported. On the upper turret 5, a plurality of punches 9 is detachably installed so as to be lined up in circumferential and radial directions of the upper turret 5. On the lower turret 7, plurality of die 11 each corresponding to one of punches 9 are detachably installed. Also, a striker 13 for striking said punches 9 is so provided on the frame 3 as freely to reciprocate in a vertical direction and also as to be movable in radial direction of the upper turret 5 so that it can strike the punches 9 installed at different positions in radial direction of the upper turret 5.

Further, a positioning device 15 is installed on the frame 3. This positioning device carries out the positioning of a sheet material W to be processed. As is well known, said positioning device 15 comprises a carriage base 17 which can move freely in a Y-axis direction (left-right direction in FIG. 1) to move towards or away from said upper and lower turrets 5, 7. The carriage base 17 supports a carriage 19 which can freely move in an X-axis direction, normal to the Y-axis. The carriage 19 is provided with a plurality of work clamps 21 for holding the sheet material W.

Since the turret punch press 1 as constructed as described above is well known, no further explanation regarding the detailed construction and function will be made.

Figure 4:
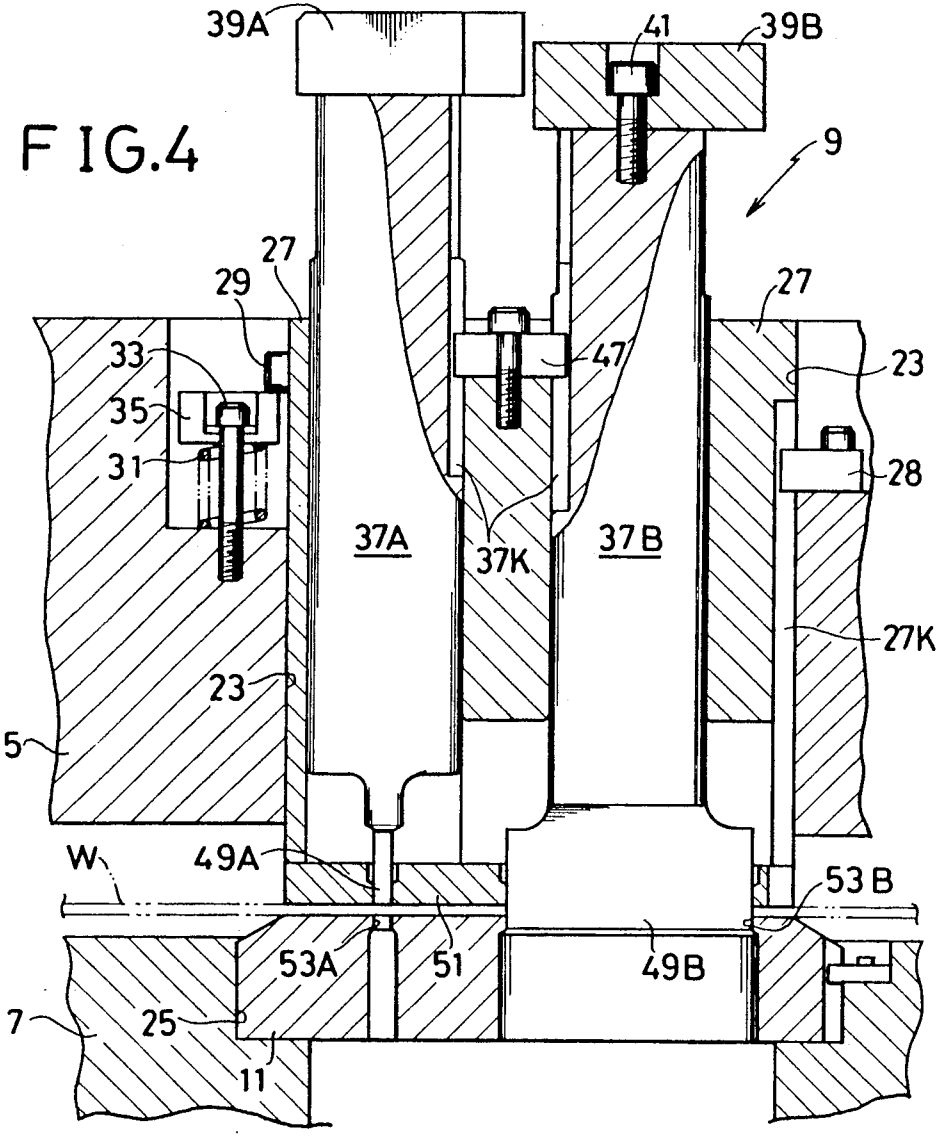
FIG. 4 is a front view of a punch of an embodiment according to the present invention and corresponds to a section taken along line IV—IV in FIG. 2.

Referring to FIGS. 2–5, a punch as an embodiment of the present invention is now explained. Referring particularly to FIG. 4, the punch 9 is detachably installed in a punch installing portion 23 formed in the upper turret 5. Also a die 11 corresponding to the punch 9 is installed in a die installing portion 25 formed in said lower turret 7. That is to say, at the punch installing portion 23 circular vertical through-hole 23 is formed, and said punch 9 is ditachably mounted so as to be movable in the vertical direction. More particularly, a punch holder 27 having a cylindrical shape is so fitted into the punch installing portion 23 as to be movable in vertical direction. A plurality of pins 29 secured to the upper part of the circumferential surface of said punch holder 27, projecting horizontally outwardly therefrom. Through each of these pins 29, the punch holder 27 is so supported to be movable in vertical direction by lifter springs 31 which is arranged at several parts of the upper turret 5 around the punch installing portion 23. More particularly, as shown in FIG. 4, bolt 33 is fixed onto parts of the upper turret 5 around the punch installing portion 23; and said lifter spring 31 is resiliently installed between the upper turret 5 and a rising and descending block 35 which is so mounted on the bolt 33 to be movable in the vertical direction along said bolt 33. The pin 29 is supported by the rising and descending block 35 which is always urged towards the upward direction by the lifter spring 31. Accordingly, the punch holder 27 is supported by the lifter spring 31, and thus can be pushed downwards against the lifter spring 31. The outer circumferential surface of said punch holder 27 is formed with a vertical keyway 27K. A key 28 which is fixed to the upper turret 5 engages the keyway 27K, and thus prevents the turning of the punch holder 27.

Figure 2:
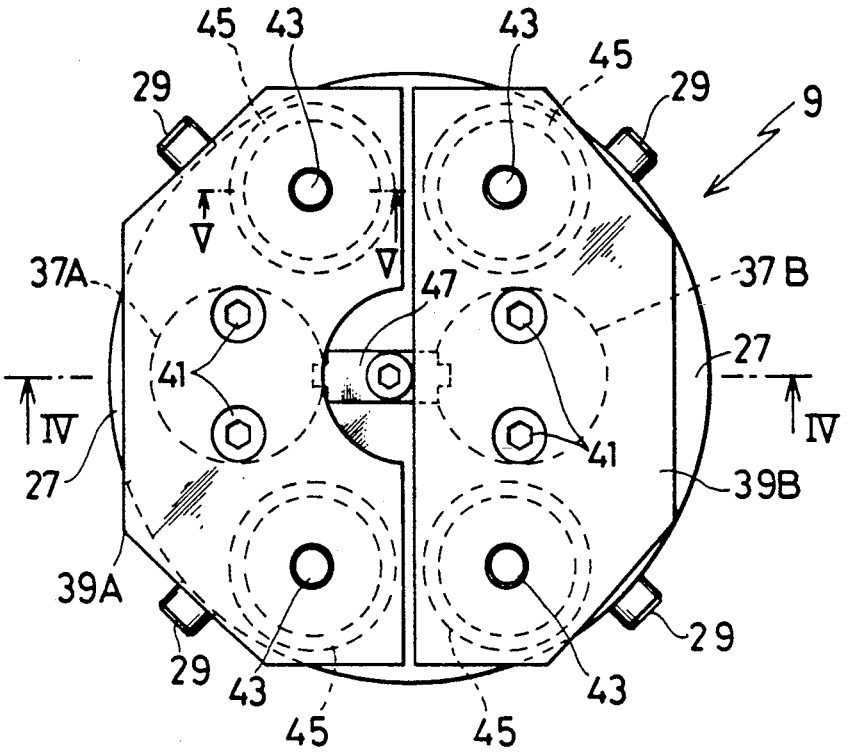
FIG. 2 is a plan view of the punch of an embodiment according to the present invention.
Figure 3:
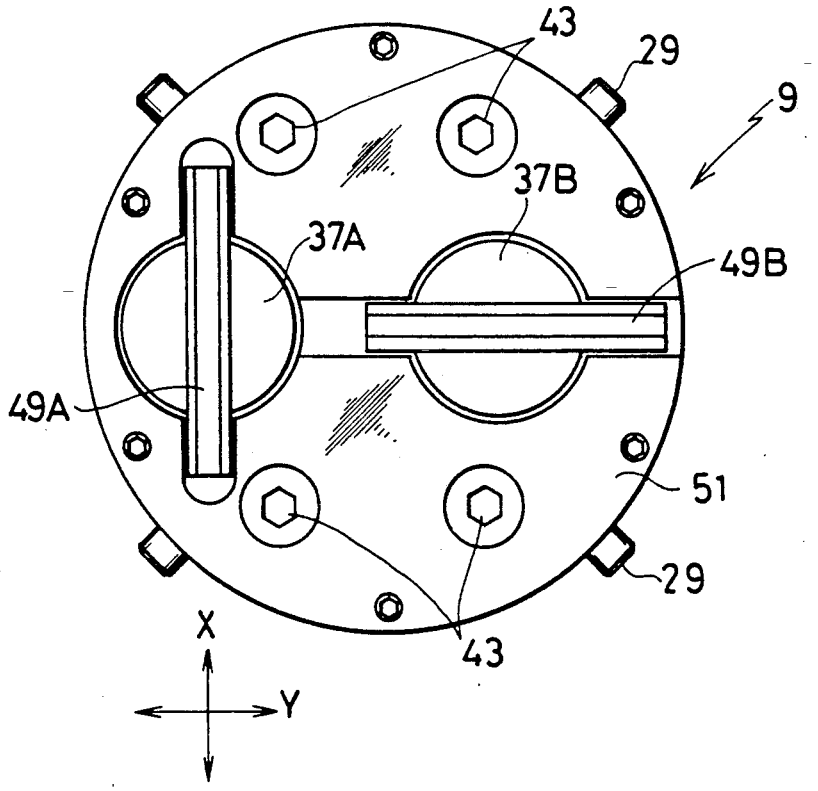
FIG. 3 is a bottom view of the punch of an embodiment according to the present invention.
Figure 5:
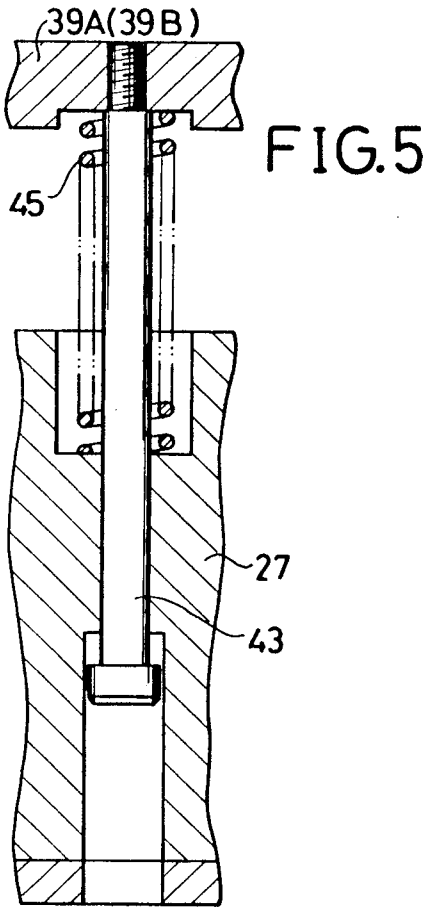
FIG. 5 is a sectional view of the punch of an embodiment according to the present invention taken along line V—V in FIG. 2.

A plurality of punch bodies 37A, 37B is so supported on the punch holder 27 as to be movable in the vertical direction. As shown in FIGS. 2, 4 and 5, punch heads 39A, 39B in the form of thick plates are secured to the upper end portions of the respective punch bodies 37A, 37B through a plurality of bolt 41. Each punch head 39A, 39B is, as shown in FIG. 2, threaded with a stopper bolt 43 which is so mounted on the punch holder 27 as to penetrate the punch holder 27 and be movable in the vertical direction. Also, a strong stopper spring 45 is resiliently installed between each punch head 39A, 39B and the punch holder 27. Accordingly, each punch head 37A, 37B is always urged upwards from the punch holder 27 by the resilience of the stopper spring 45.

The punch body 37A, 37B is respectively formed with a keyway 37K. A key 47 which is secured to the punch holder 27 engages the each keyway 37K. Thus, each punch body 37A, 37B is prevented to turn against the punch holder 27.

Shearing blade portions 49A, 49B are provided respectively at the lower ends of the punch bodies 37A, 37B. As shown particularly in FIG. 3, the shearing blade portions are formed in elongated shapes. The respective shearing blade portions 49A, 49B extend in directions which intersect each other, and in the present embodiment, extend in X-axis directions and Y-axis directions. A sheet retainer 51 for retaining the sheet material W while the sheet material W is punched by the respective shearing blade portions 49A, 49B, is secured to the lower end of the punch holder 27.

The dies 11 are formed with die holes 53A, 53B which correspond respectively to said respective shearing blade portions 49A, 49B.

In the configuration described above, in order to form a L-shaped slit in the sheet material W, the punch 9 and die 11 are first positioned below the striker 13 by rotating the turrets 5, 7, and the striker 13 is moved in radial direction of the turret 5 and 7 to be positioned above one of the punch bodies 37A. 37B, for instance to the punch body 37*a*. Then the workpiece W held by the work clamp 21 is initially moved to a predetermined direction so as for a desired part thereof to be positioned between the punch and die 9 and 11. After the initial positioning of the workpiece W, the striker 13 is repeatedly applied to the punch body 37*a* while the workpiece W is moved in the X-axis direction by a predetermined length for each striking operation, so that one edge of the L-shaped slit in X-axis direction is formed on the workpiece W.

After a slit having required length in the X-axis direction is formed on the sheet material, nextly, the striker 13 is applied to the other punch body 37B, and by performing punching operations while moving the sheet material W in the direction of Y-axis, the other edge of the L-shaped slit in the Y-axis direction is formed on the sheet material W.

Thus, it will be understood that a small piece of product can be sheared and separated from a large sheet material by making the L-shaped slit in an end region of the large sheet material or by making slits in the X- and Y-axis direction surrounding the required region of the large sheet material.

That is to say, according to the present embodiment, by properly selecting and using punch bodies 37A, 37B, and by performing punching operations on the sheet material W while moving the sheet material W in the X-axis or Y-axis directions, a product of desired size can be easily sheared and separated from the large sheet material. Moreover, since the punch bodies 37A, 37B are mounted on the same punch holder 27 and lie adjacent to each other, for example, a rapid change can be made from the process of making the slit in the X-axis direction to that making the slit in the Y-axis direction. Also, since the shearing and separation of the small product can be performed immediately after a conventional punching operation being completed, the operation efficiency is improved.

As can be understood from the explanation of the embodiment of the present invention as described above, in accordance with the present invention, a product can be sheared and separated from a sheet material by use of a punch press. Therefore, the processing of shearing and separating products having various sizes from a large sheet material can be made quickly and with good accuracy.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A punch tool for a punch press provided with a plurality of striking positions at which a striker is selectively placed for punching a workpiece, said punch press also being provided with a tool support means for supporting said punch tool, said punch tool comprising:

a punch holder having a key way, said punch holder being detachably inserted into a punch installation portion formed in the tool support means and held in place by a key attached to said support means;

a pair of punch bodies so supported on said punch holder as to be independently movable in the vertical direction, said pair of punch bodies so located as to be concurrently aligned with a pair of respective striking positions, said punch bodies each having a keyway, said keyways aligned to engage a single key fixedly attached to said punch holder;

a pair of shearing blade portions formed on the lower ends of the pair of punch bodies, respectively, said pair of shearing blade portions having elongated configurations so guided by guide means as to have their elongated directions extending perpendicular to one another; and a die detachably inserted into a die installation portion formed in the tool support means, the die having a pair of die holes corresponding to the pair of shearing blade portions.

2. The punch tool of claim 1, wherein said punch holder includes a bottom end section, further comprising:

a sheet retainer formed on the bottom end section of the punch holder, for securely retaining the workpiece to be punched by either one of the shearing blade portions.

3. The punch tool of claim 2, wherein one of the shearing blade portions having an elongated configuration is so oriented that the elongation direction of said one shearing blade portion points at a central portion of the other of said shearing blade portions.

4. The punch tool of claim 2, wherein the extending directions of the pair of shearing blade portions are parallel respectively to X and Y directions along which the workpiece is moved by a workpiece positioning device that is provided on the punch press.

5. The punch tool of claim 1, wherein one of the shearing blade portions having an elongated configuration is so oriented that the elongation direction of said one shearing blade portion points at a central portion of the other of said shearing blade portions.

6. The punch tool of claim 5, wherein the extending directions of the pair of shearing blade portions are parallel respectively to X and Y directions along which the workpiece is moved by a workpiece positioning device that is provided on the punch press.

7. The punch tool of claim 1, wherein the extending directions of the pair of shearing blade portions are parallel respectively to X and Y directions along which the workpiece is moved by a workpiece positioning device that is provided on the punch press.

8. A punch press for punching holes in a generally horizontal workpiece, said punch press comprising:

a frame;

a plurality of striking positions at which a striker is selectively placed for striking a punch tool;

a tool support means formed with a punch installation portion and a die installation portion for supporting a punch-and-die set and aligning the said punch-and-die set with one of the striking positions;

at least one punch-and-die set including a punch holder with guide means detachably insertable into the punch installation portion in a vertically movable manner, a pair of punch bodies so installed on said punch holder as to be independently movable in the vertical direction, said punch bodies each having a keyway, said keyways aligned to engage a single key fixedly attached to said punch holder, said pair of punch bodies so located as to be concurrently aligned with a pair of respective striking positions, a pair of shearing blade portions formed on the lower ends of the pair of punch bodies respectively, said pair of shearing blade portions having elongated configurations so guided by guide means as to have their elongated directions crossing one another at the central portion of either one of the shearing blade portions at a right angle, and a die with guide means, detachably inserted into said die installation portion, said die having a pair of die holes corresponding to the pair of shearing blade portions respectively.

* * * * *